United States Patent [19]

Ishikawa et al.

[11] Patent Number: 4,944,801

[45] Date of Patent: Jul. 31, 1990

[54] PROCESS FOR PREPARING POWDER OF AN ALLOY OF A RARE EARTH ELEMENT, IRON AND BORON FOR A RESIN BONDED MAGNET

[75] Inventors: Takashi Ishikawa; Nobumitsu Oshimura; Kenji Ohmori, all of Ichikawa, Japan

[73] Assignee: Sumitomo Metal Mining Co. Ltd., Japan

[21] Appl. No.: 375,459

[22] Filed: Jul. 5, 1989

[30] Foreign Application Priority Data

Jul. 7, 1988 [JP] Japan ..... 63-167727

[51] Int. Cl.[5] ..... H01F 1/053; H01F 1/09

[52] U.S. Cl. ..... 75/349; 75/350; 148/105

[58] Field of Search ..... 420/83, 121; 75/0.5 BA, 75/348, 349, 350; 148/102, 105, 121

[56] References Cited

U.S. PATENT DOCUMENTS 4,767,450 8/1988 Ishigaki et al. ..... 75/0.5 BA
4,769,063 9/1988 Ishigaki et al. ..... 75/0.5 BA
4,770,702 9/1988 Ishigaki et al. ..... 420/83
4,773,950 9/1988 Fujimura et al. ..... 420/121

FOREIGN PATENT DOCUMENTS 126802 12/1984 European Pat. Off. ..... 148/102
184722 6/1986 European Pat. Off. ..... 420/83

*Primary Examiner*—Theodore Morris
*Assistant Examiner*—George Wyszomierski
*Attorney, Agent, or Firm*—Watson, Cole, Grindle & Watson

[57] ABSTRACT

A powder of a rare earth oxide, or a powder of a rare earth oxide and a rare earth metal is mixed with a powder containing iron, a powder containing boron and at least one material selected from among an alkali metal, an alkaline earth metal and a hydrogenated product thereof. The mixture is heated at a temperature of 900° C. to 1200° C. in a non-oxidizing atmosphere, subjected to wet treatment, and heated again at a temperature of 650° C. to 1100° C., whereby an alloy powder is obtained. Alternatively, the mixture is heated at a temperature of 900° C. to 1200° C., crushed into coarse particles, heated again at a temperature of 650° C. to 1100° C. and subjected to wet treatment. The powder is pulverized into a finer powder having an average particle diameter of 1 to 10 microns. The powder is used for making a magnet with a resin.

6 Claims, No Drawings

PROCESS FOR PREPARING POWDER OF AN ALLOY OF A RARE EARTH ELEMENT, IRON AND BORON FOR A RESIN BONDED MAGNET

BACKGROUND OF THE INVENTION

1. Field of the Invention:

This invention relates to a process for preparing a powder of an alloy of a rare earth element, iron and boron which is used for making a resin bonded magnet.

2. Description of the Prior Art:

A magnet material composed of a rare earth element, iron and boron is known. A typical example is an alloy of neodymium (Nd), iron and boron. This class of material has drawn attention, since it has better magnetic properties and is less expensive than another type of magnet material that is composed of samarium (Sm) and cobalt (Co). The powder of an alloy of a rare earth element, iron and boron which is used for making a magnet is prepared by the melting process or the reduction and diffusion process.

According to the melting process, the starting materials, e.g., pure iron, an alloy of iron and boron and a rare earth metal, are melted, the melt is cast to form an ingot, the ingot is crushed into coarse particles, and the coarse particles are pulverized.

The reduction and diffusion process is started by mixing a powder of a rare earth oxide or a powder of a rare earth oxide and a rare earth metal, a powder containing iron, a powder containing boron, and at least one of an alkali metal, an alkaline earth metal and a hydrogenated product thereof. The mixture is heated at a temperature of 900° C. to 1200° C. in a non-oxidizing atmosphere, e.g., in an inert gas atmosphere or in a vacuum. The resulting reaction mixture containing CaO and residual calcium is subjected to wet treatment.

Both of the processes are, however, deficient. The materials which the melting process employs are expensive and more than one step of crushing is required. The reduction and diffusion process can produce only an alloy powder of low magnetic properties.

SUMMARY OF THE INVENTION

It is, therefore, an object of this invention to provide an improved reduction and diffusion process which can produce a powder of an alloy of a rare earth element, iron and boron having good magnetic properties which can be used directly for manufacturing a resin bonded magnet of good properties.

This object is attained by a process which comprises mixing a powder of a rare earth oxide or a powder of a rare earth oxide and a rare earth metal, a powder containing iron, a powder containing boron, and at least one material selected from among an alkali metal, an alkaline earth metal and a hydrogenated product thereof, heating the mixture at a temperature of 900° C. to 1200° C. in a non-oxidizing atmosphere, subjecting the mixture to wet treatment, heating it at a temperature of 650° C. to 1100° C., whereby an alloy powder is obtained, and pulverizing the powder into a fine powder having an average particle diameter of 1 to 10 microns.

Alternatively, the mixture which has been heated at the temperature of 900° C. to 1200° C. is coarsely crushed and is, then, heated at the temperature of 650° C. to 1100° C. before it is subjected to the wet treatment.

The alloy powder which is produced by the process of this invention can be used for making with a resin a magnet having high magnetic properties.

DETAILED DESCRIPTION OF THE INVENTION

According to a salient feature of the process of this invention, the mixture which has been heated at a temperature of 900° C. to 1200° C. is heated again at a temperature of 650° C. to 1100° C. When the alloy powder which had been prepared without following any such secondary heating was studied by powder X-ray diffraction employing $CuK_{\alpha}$-rays, there was obtained a diffraction chart containing a peak at an angle $2\theta$ of 28.2°. The magnetic properties of the powder were undesirably low, apparently due to the presence of the substance which had formed the peak. Secondary heating prevents the formation of any such substance and thereby enables the preparation of an alloy powder yielding a magnet which is improved in magnetic properties, particularly coercive force and squareness. No satisfactory result of such heating can, however, be obtained at any temperature that is lower than 650° C. The use of any temperature exceeding 1100° C. should also be avoided, as it is likely to cause partial melting or sintering of the material which is heated. The duration of secondary heating is usually in the range of 0.5 to two hours, though there is no critical limitation.

The wet treatment of the mixture comprises treatment with water and an aqueous solution of an acid, washing and drying. The treatment with water is intended for removing the by-products of the reaction, such as oxide of an alkali or alkaline earth metal used as a reducing agent, and the remaining reducing agent. The treatment with an aqueous solution of an acid is conducted for removing the hydroxide of the alkali or alkaline earth metal which still remains after the treatment with water.

The wet treatment may be carried out either before the secondary heating at a temperature of 650° C. to 1100° C., or thereafter. From the standpoint of magnetic properties, however, it is preferable to conduct the wet treatment before the secondary heating. If it is conducted thereafter, the substance forming the peak at the angle $2\theta$ of 28.2° which has disappeared as a result of the secondary heating is apparently produced again during the wet treatment, though in a quantity not recognized as any such peak. If the wet treatment is conducted after the secondary heating, it is necessary to crush the reaction mixture coarsely, but preferably into particles having an average diameter not exceeding 10 mm, before it is heated at a temperature of 650° C. to 1100° C., so that its secondary heating may be effective.

The alloy powder is finally pulverized. Before it is pulverized, the powder usually has an average particle diameter of 20 to 1000 microns and a polycrystalline structure containing a polycrystalline principal phase expressed as (rare earth metal)$_2$(Fe or Fe and Co)$_{14}$B. If it is used for making a magnet with a resin, the magnet is likely to have very low magnetic properties. Therefore, it is necessary to pulverize the powder until it has a single crystal structure of (rare earth metal)$_2$ (Fe or Fe and Co)$_{14}$B phase. More specifically, it is necessary to pulverize it until it has an average particle diameter of 1 to 10 microns, and preferably 1 to 8 microns. If the powder has an average particle diameter which is smaller than one micron, it is easily oxidizable, while hardly any satisfactory coercive force can be expected from any powder having an average particle diameter exceeding 10 microns.

The powder of an alloy of a rare earth element, iron and boron which is produced by the process of this invention as hereinabove described can make with a resin a magnet which is excellent in all of magnetic properties, i.e., remanence, coercive force, squareness and maximum energy product.

The invention will now be described more specifically with reference to a number of examples thereof.

EXAMPLE 1

A mixed powder was prepared by mixing 5.6 g of $Nd_2O_3$ powder having a purity of 99.9% by weight, 23 g of $Dy_2O_3$ powder having a purity of 99.9% by weight, 120 g of iron powder having a purity of 99% by weight, 13 g of ferroboron powder having a boron content of 20% by weight, 33 g of metallic calcium having a purity of 99% by weight and 9 g of $CaCl_2$ having a purity of 99% by weight. The mixed powder was placed in a stainless steel vessel, heated to 1000° C. in an argon gas atmosphere, held at that temperature for three hours, and cooled to room temperature, whereby a reaction mixture was obtained. The mixture was placed in five liters of water, whereby CaO was reacted with water to form $Ca(OH)_2$, and the mixture was, then, treated with dilute acetic acid of pH 5 whereby an alloy powder was obtained. After the water adhering to the powder had been replaced by ethanol, it was dried in a vacuum. The powder was found to contain 21.6% by weight of Nd, 10.4% by weight of Dy, 66.1% by weight of Fe, 1.13% by weight of B, 0.07% by weight of Ca and 0.2% by weight of oxygen.

Several samples of powder were prepared as hereinabove described. The samples, except No. 5, were heated in an argon gas atmosphere under different conditions as shown in TABLE 1, and cooled to room temperature. The average particle diameter of each sample was, then, determined by Fischer sub-sieve sizer. The results are shown in TABLE 1.

Then, each sample was pulverized in a vibrating mill until it had an average particle diameter of 4.0 microns as determined by Fischer sub-sieve sizer. Different lengths of time were employed for pulverizing the samples, as shown in TABLE 1. Each finely divided sample was studied by X-ray diffraction and examined through an electron microscope. The study by X-ray diffraction employing $CuK_\alpha$-rays revealed a distinct peak at $2\theta=28.2°$ in the diffraction chart of each of the samples shown as Runs Nos. 5 to 7, while no such peak was found in the diffraction chart of any of Runs Nos. 1 to 4.

TABLE 1

| Run No. | Heating temp. (°C.) | Holding time (h) | Average particle (μm) | Pulverizing time (h) | Magnetic properties Br (kG) | iHc (kOe) | Hk/iHc | $(BH)_{max}$ (MGOe) | Remarks |
|---|---|---|---|---|---|---|---|---|---|
| 1 | 650 | 1 | 70 | 1.3 | 7.3 | 3.9 | 0.65 | 10.8 | Example |
| 2 | 800 | 1 | 130 | 1.5 | 7.5 | 4.5 | 0.69 | 12.5 | Example |
| 3 | 1000 | 0.7 | 180 | 1.8 | 7.4 | 4.4 | 0.68 | 12.2 | Example |
| 4 | 1100 | 0.7 | 200 | 2.0 | 7.2 | 4.1 | 0.68 | 11.5 | Example |
| 5 | Not heated | | 23 | 0.9 | 6.7 | 2.9 | 0.47 | 7.1 | Comparative Example |
| 6 | 400 | 1 | 24 | 1.0 | 2.4 | 1.0 | 0.33 | 0.7 | Comparative Example |
| 7 | 600 | 1 | 26 | 1.0 | 2.3 | 0.9 | 0.31 | 0.5 | Comparative Example |

The examination of the samples through an electron microscope revealed that all of them had a single crystal structure of principal $(Nd,Dy)_2Fe_{14}B$ phase.

Each sample was mixed with 3% by weight of an epoxy resin and oriented in a magnetic field having a strength of 15 kOe. The mixture was molded at a pressure of 5 tons/cm$^2$ nd the molded mixture was heated at 20° C. in an argon gas atmosphere, whereby the resin was cured and a magnet was obtained. The magnetic properties of each magnet are shown in TABLE 1.

EXAMPLE 2

The procedure of EXAMPLE 1 were followed for preparing a reaction mixture. The mixture was coarsely crushed, whereby several samples of mixture each having an average particle diameter not exceeding 5 mm were prepared.

The samples, except No. 12, were heated in an argon gas atmosphere under different conditions as shown in TABLE 2, and cooled to room temperature. Then, the procedures of EXAMPLE 1 were followed for the wet treatment of each sample. The alloy powder thereby obtained was of the same composition as the powder which had been obtained in EXAMPLE 1. The average particle diameter of each sample is shown in TABLE 2.

The procedure of EXAMPLE 1 was followed for pulverizing each sample of alloy powder, except that different lengths of pulverizing time were employed, as shown in TABLE 2. Each finely divided sample was studied by X-ray diffraction and examined through an electron microscope, as each sample had been in EXAMPLE 1. The study by X-ray diffraction revealed a distinct peak at $2\theta=28.2°$ in the diffraction chart of each of the samples shown as Runs Nos. 12 to 14, while no such peak was found in the diffraction chart of any of Runs Nos. 8 to 11. The examination of the samples through an electron microscope revealed that all of them had a single crystal structure of principal $(Nd,Dy)_2Fe_{14}B$ phase.

The procedures of EXAMPLE 1 were followed for making a magnet from each sample. The magnetic properties of each magnet are shown in TABLE 2.

TABLE 2

| Run No. | Heating temp. (°C.) | Holding time (h) | Average particle (μm) | Pulverizing time (h) | Magnetic properties Br (kG) | iHc (kOe) | Hk/iHc | $(BH)_{max}$ (MGOe) | Remarks |
|---|---|---|---|---|---|---|---|---|---|
| 8 | 650 | 1.5 | 30 | 1.1 | 6.9 | 3.2 | 0.59 | 8.5 | Example |
| 9 | 800 | 1.5 | 32 | 1.1 | 7.3 | 3.7 | 0.68 | 10.0 | Example |
| 10 | 1000 | 1 | 37 | 1.2 | 7.2 | 3.6 | 0.61 | 9.5 | Example |
| 11 | 1100 | 1 | 39 | 1.2 | 7.1 | 3.4 | 0.59 | 9.0 | Example |
| 12 | Not heated | | 23 | 0.9 | 6.7 | 2.9 | 0.47 | 7.1 | Comparative Example |
| 13 | 400 | 1.5 | 23 | 0.9 | 2.5 | 1.2 | 0.35 | 0.8 | Comparative Example |
| 14 | 600 | 1.5 | 24 | 1.0 | 2.1 | 0.9 | 0.32 | 0.5 | Comparative Example |

What is claimed is:

1. A process for preparing a powder of an alloy of a rare earth element, iron and boron used for making a magnet with a resin, comprising:

mixing a powder of a rare earth oxide or a powder of a rare earth oxide and a rare earth metal, a powder containing iron, a powder containing boron, and at least one material selected from the group consisting of an alkali metal, an alkaline earth metal and a hydrogenated product thereof;

heating their mixture to a temperature of 900° C. to 1200° C. in a non-oxidizing atmosphere;

crushing said mixture coarsely;

heating said mixture to a temperature of 650° C. to 1100° C.;

subjecting said mixture to wet treatment, whereby an alloy powder is obtained; and pulverizing said powder into a finer powder having an average particle diameter of 1 to 10 microns.

2. A process as set forth in claim 1, wherein said wet treatment comprises treatment with water, treatment with an aqueous solution of an acid, washing, and drying.

3. A process as set forth in claim 1, wherein said crushing is done until said mixture has an average particle diameter not exceeding 10 mm.

4. A process as set forth in claim 1, including maintaining said mixture at said temperature of 650° C. to 1100° C. for a period of 0.5 to two hours.

5. A process as set forth in claim 1, wherein said powder to be pulverized has an average particle diameter of 20 to 1000 microns.

6. A process as set forth in claim 1, wherein said finer powder has an average particle diameter of 1 to 8 microns.

* * * * *